US008800423B1

(12) United States Patent
Lammers

(10) Patent No.: US 8,800,423 B1
(45) Date of Patent: Aug. 12, 2014

(54) SEMI-AUTOMATIC RIFLE

(76) Inventor: Mark Anthony Lammers, Delaware, OH (US)

( * ) Notice: Subject to any disclaimer, the term of this patent is extended or adjusted under 35 U.S.C. 154(b) by 270 days.

(21) Appl. No.: 13/316,498

(22) Filed: Dec. 10, 2011

Related U.S. Application Data

(63) Continuation-in-part of application No. 12/611,117, filed on Nov. 3, 2009, now abandoned.

(51) Int. Cl.
*F41A 5/20* (2006.01)

(52) U.S. Cl.
USPC ..... 89/191.01; 89/192

(58) Field of Classification Search
USPC ..... 89/191.01, 191.02, 192
See application file for complete search history.

(56) References Cited

U.S. PATENT DOCUMENTS

| | | | | |
|---|---|---|---|---|
| 1,892,141 | A | 12/1932 | Garand | |
| 2,389,631 | A | 11/1945 | Moore | |
| 3,003,400 | A * | 10/1961 | Johnson | 89/14.05 |
| 4,207,798 | A * | 6/1980 | Hayashi | 89/191.01 |
| 4,527,348 | A | 7/1985 | Brennan | |
| 5,937,563 | A | 8/1999 | Schuetz et al. | |
| RE40,216 | E | 4/2008 | Swan | |
| 7,739,939 | B2 | 6/2010 | Adams | |
| 2007/0199225 | A1 * | 8/2007 | Haugen | 42/85 |

* cited by examiner

*Primary Examiner* — Daniel J Troy
(74) *Attorney, Agent, or Firm* — James R. Eley; Michael A. Forhan; Eley Law Firm Co., LPA

(57) ABSTRACT

A gas-operated semi-automatic rifle having a barrel group, a receiver group, a bolt group, a stock group, a trigger group, and a magazine group. The barrel group includes a gas-operated operating rod, the operating rod further including a follower rod, the operating rod being biased away from the follower rod. The receiver group includes a receiver body. A cavity is formed in a forward portion of the receiver body, the cavity being sized and shaped to receive and movably retain a proximal end of the follower rod.

20 Claims, 8 Drawing Sheets

SEMI-AUTOMATIC RIFLE

This application is a continuation-in-part of U.S. patent application Ser. No. 12/611,117, filed Nov. 3, 2009, the entire contents of which are hereby incorporated by reference.

FIELD

This invention relates to firearms, more particularly, to semi-automatic types of rifles.

BACKGROUND

The U.S. "M1" rifle, also known as the M1 Garand rifle, was the main battle rifle of the U.S. military from 1936 to 1957. While considered to be technologically advanced in its time, the M1 suffers from several shortcomings. For example, the gas operating system employed on the M1 utilizes an operating rod that is nearly as long as the barrel and a gas cylinder that is mounted very close to the barrel. In order for the rifle to function properly the operating rod must bent in a manner to clear the stock. These bends in the operating rod, combined with its length, result in a fragile system that is not capable of withstanding pressures associated with more modern ammunition or higher pressure calibers.

A clip is a device that is used to store multiple rounds of ammunition together as a unit, ready for insertion into a receptacle of a firearm. This speeds up the process of loading and reloading the firearm because several rounds can be loaded at once, rather than one round being loaded at a time. The M1 rifle is designed to feed ammunition from eight-round en bloc clips. With this design, both the round and the clip are inserted as a unit into a fixed magazine within the rifle, and the clip is usually ejected or falls from the rifle upon firing or chambering of the last round. The M1 is configured such that rounds are fed from the top of the rifle, though an open receiver top, requiring that any added optics or other accessories be mounted on the side of the receiver. The en bloc clip has the further shortcoming of limiting magazine capacity to eight rounds.

The M1 rifle also uses an indirect bolt stop mechanism that acts on the operating rod, not the bolt itself. The design of the stock on the M1 rifle employs two hand guards to cover the barrel and the operating rod, and which extends nearly to the muzzle of the rifle, thereby limiting barrel diameter and preventing the implementation of a free floating barrel/gas system. Rifles of similar design have usually suffered from similar limitations or utilize gas systems having multiple moving parts. Such rifles have also been limited to short-action rifle round, e.g. .308, of limited power and versatility.

What is needed is a rifle comparable in simplicity to the M1 rifle with all its desirable qualities and rugged reliability when used as designed, yet able to handle higher-pressure loads, longer-action calibers, e.g., .30-06, .300 WM through .458M, modern optics, and free float barrel groups for enhanced accuracy, while accommodating shorter barrel lengths and overall configurations.

SUMMARY

The present invention is a rifle that utilizes a short, straight operating rod with a piston attached directly to the rod, available commercially as the LOSOK Valkyr™ rifle from LOSOK Custom Arms, LLC of Delaware, Ohio. This system has fewer moving parts than prior short stroke systems. Gas generated by a fired found is directed from the barrel to a gas cylinder via a port drilled in the bottom of the barrel, the gas causing rearward movement of the operating rod against a biasing element as each round is fired. This arrangement allows the use of a wider variety of barrels and operating rods made to custom lengths and configurations as needed to accommodate various calibers and specialty uses.

The present invention is also a closed-top design with optional optics mounting rails oriented at 9 and 12 o'clock positions on the receiver (as viewed from the rear), and with a detachable box magazine feeding from the bottom of the rifle. The rail portions may be integrated into the receiver body or fabricated as discrete components and then attached to the receiver in any number of ways.

The receiver of the present invention incorporates a bolt stop, which is activated by the magazine follower upon firing the last round to retain the bolt in an "open" position until released by pressing a bolt stop release on the exterior of the receiver. The stock group of the current invention is combined with the trigger group and receiver with an integral magazine well serve to provide a free floating barrel and gas system for improved accuracy and reliability and forward optics mounting by the height adjustable hand guard with optics rail. The operation of the action of the current invention is also enhanced by a closely fitted operating rod guide and spring of a new design which, coupled with the straight operating rod, provides smooth and accurate operation in varying climates.

In one embodiment of the present invention a gas-operated semi-automatic rifle comprises a barrel group, a receiver group, a bolt group, a stock group, a trigger group, and a magazine group. The barrel group includes a gas-operated operating rod, the operating rod further having a follower rod, the operating rod being biased away from the follower rod. The receiver group includes a receiver body. A cavity is formed in a forward portion of the receiver body, the cavity being sized and shaped to receive and movably retain a proximal end of the follower rod.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
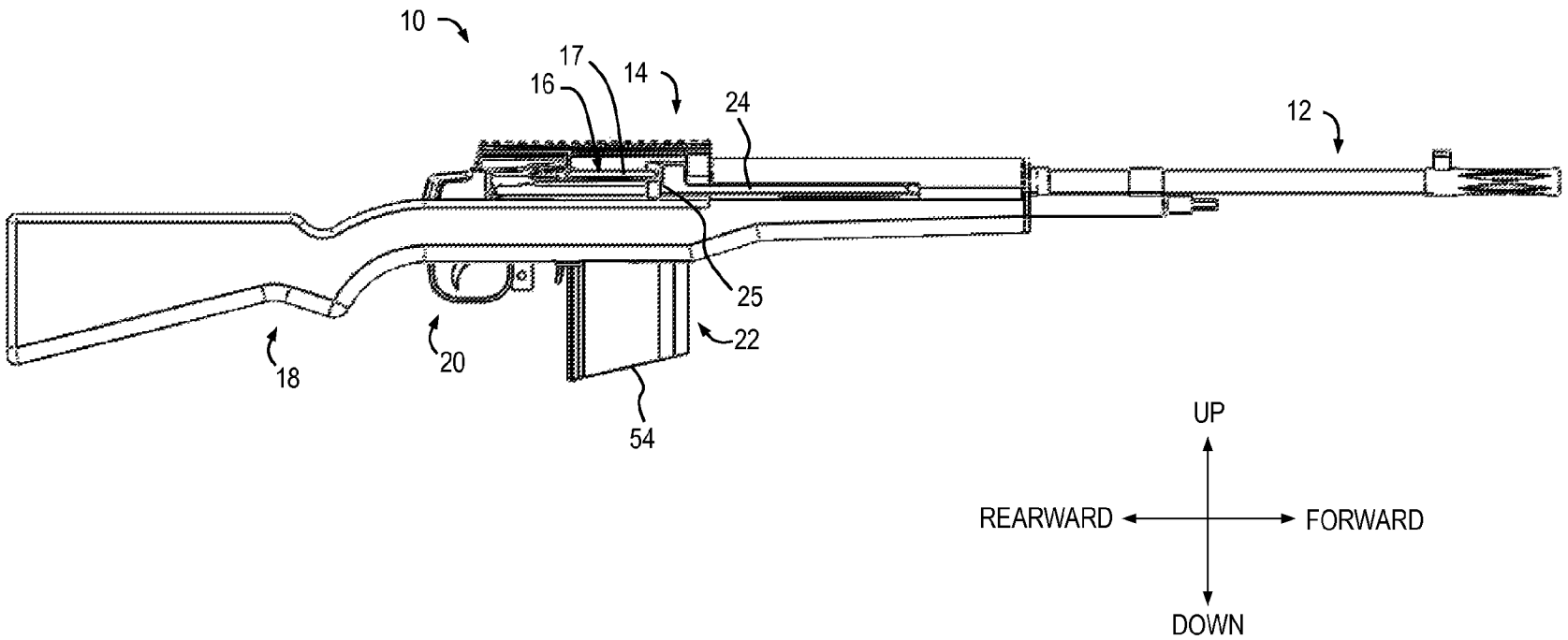
FIG. 1 shows the general arrangement of a semi-automatic rifle according to an embodiment of the present invention.

The general arrangement of a semi-automatic rifle 10 is shown in FIG. 1 according to an embodiment of the present invention. Rifle 10 consists of a plurality of parts groups that work and function together to facilitate the operation of the rifle as a whole. In particular, rifle 10 comprises a barrel group 12, a receiver group 14, a bolt group 16, a stock group 18, a trigger group 20, and a magazine group 22.

Figure 2:
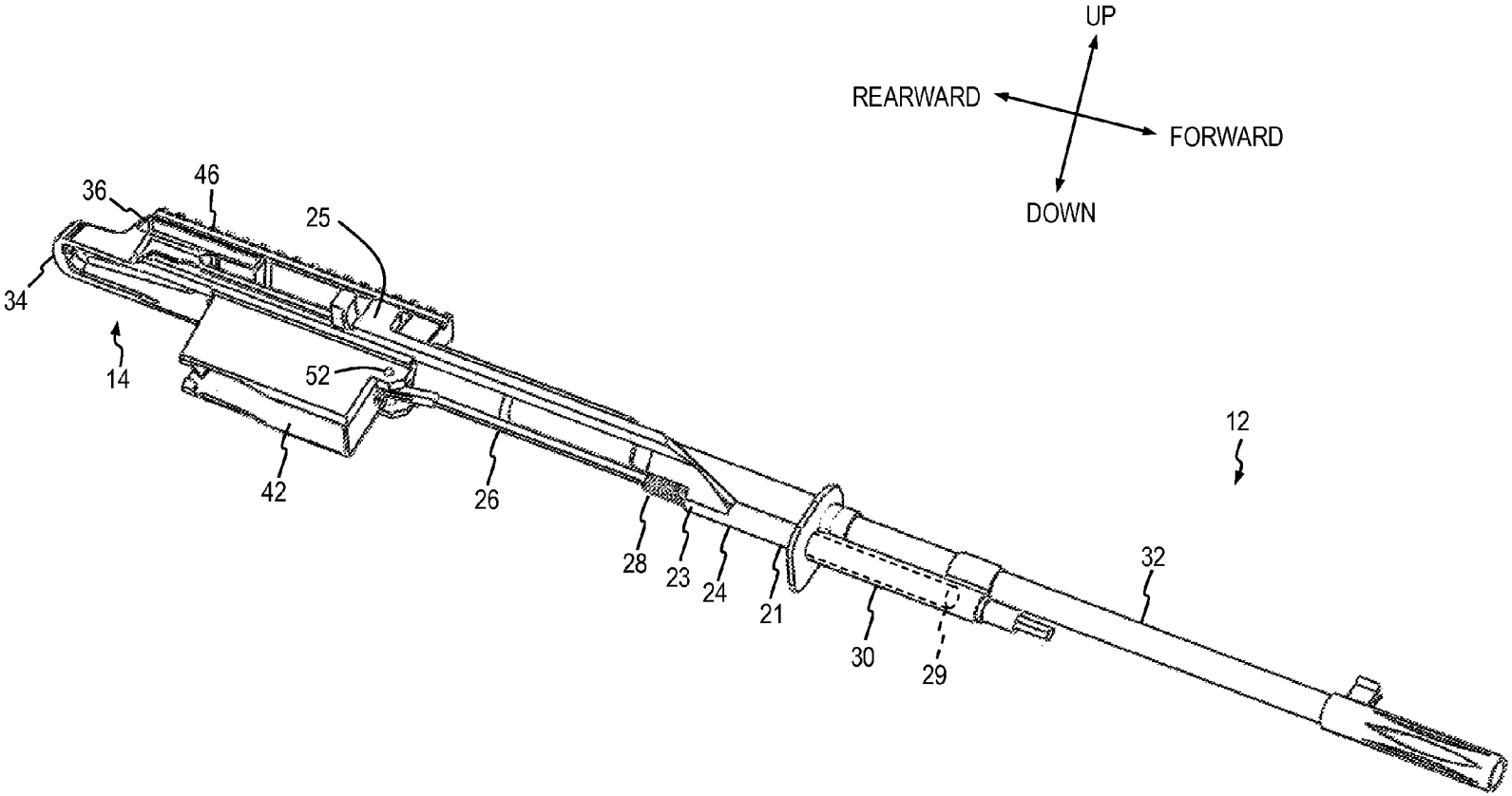
FIG. 2 shows details of a barrel group and a receiver group of the rifle of FIG. 1.

With reference now to FIG. 2, barrel group 12 includes a relatively short, generally straight gas-operated operating rod 24 coupled to a follower rod 26, the operating rod being biased forward away from the follower rod by a biasing element 28. The biasing element 28 is configured to receive a forward distal end 27 of the follower rod 26 (see FIG. 7). The operating rod 24 includes a forward end 21, a middle portion 23 and a rearward end 25. The rearward end 25 is configured to couple to bolt group 16 to urge a bolt 17 (see FIG. 1) forward and rearward within the receiver group 14. The middle portion 23 is configured to receive forward distal end 27 of follower rod 26 and at least a portion of biasing element 28. In one embodiment the middle portion 23 is configured to offset the forward end 21 from the rearward end 25. A piston 29 directly coupled to forward end 21 of operating rod 24 is disposed in a gas cylinder 30. Biasing element 28 biases forward end 21 of operating rod 24 toward the forward end of gas cylinder 30. Gas cylinder 30 receives from a barrel 32 combustive gases of a fired round (not shown), the gases urging piston 29 rearwardly and, in turn, urging operating rod 24 rearwardly against the bias of biasing element 28. Follower rod 26 acts to guide and brace the rearward and forward movement of forward end 21 of operating rod 24. Operating rod 24 is operably coupled to bolt group 16 to expel the spend shell casing from an expended round and then present a fresh round to the bolt for feeding into the chamber as the operating rod returns to its forward, home position. Further details relating to gas-operated semi-automatic rifles may be found in U.S. Pat. No. 1,892,141 to Garand, the entire contents of that patent being incorporated herein by reference thereto.

Preferably the components of barrel group 12 are made from one or more of steel, titanium, aluminum and polymer materials and may be formed using any suitable processes including, without limitation, casting, machining and forging. Surfaces of the components of barrel group 12 may be prepared and treated with any of a nitride finish, a blued finish and a manganese phosphate finish, or may be left unfinished. In addition, at least some of the various components of barrel group 12 may be formed as an assembly of separate components, or may be made as a unitary piece. The components of barrel group 12 may be heat treated and/or shot peened as appropriate for the materials selected for the components of the barrel group.

Details of receiver group 14 are shown in FIGS. 2 through 8. Receiver group 12 includes a receiver body 34 having a receiver cover 36, a barrel receptacle 38, a follower rod cavity 40, and a magazine well 42.

Receiver body 34 is appropriately sized and shaped to interface with barrel group 12, bolt group 16, stock group 18, trigger group 20 and magazine group 22. Receiver body 34 made be made from one or more of steel, titanium, aluminum and polymer materials and may be formed using any suitable processes including, without limitation, casting, machining and forging. Surfaces of receiver body 34 may be prepared and treated with any of a nitride finish, a blued finish and a manganese phosphate finish, or may be left unfinished. In addition, receiver body 34 may be formed as an assembly of separate components, or may be made as a unitary piece. Receiver body 34 may be heat treated and/or shot peened as appropriate for the materials selected for the receiver body.

Receiver cover 36 closes off an upper portion of receiver body 34 and provides additional structural support to a barrel 32 coupled to barrel receptacle 38. Like receiver body 34, receiver cover 36 may be made be made from one or more of steel, titanium, aluminum and polymer materials and may be formed using any suitable processes including, without limitation, casting, machining and forging. Receiver cover 36 may be finished with any of a nitride finish, a blued finish and a manganese phosphate finish, or may be left unfinished. In addition, receiver cover 36 may be formed as a separate piece and joined to receiver body 34, or may be integral with the receiver body. In some embodiments of the present invention receiver cover 36 may further include one or more accessory mounting portions, such as a MIL-STD-1913, Piccatinny style rail mount 46 shown in FIGS. 3 through 5. Rail mount 46 may be fabricated as a discrete component and then subsequently attached to receiver cover 36, or may be formed or machined as an integral feature of the receiver. Similarly, receiver body 34 may include a secondary mounting portion such as a rail mount 47, shown in FIG. 4. Likewise, rail mount 47 may be fabricated as a discrete component and then subsequently attached to receiver cover 36, or may be formed or machined as an integral feature of the receiver.

Barrel receptacle 38 is sized and shaped to receive and retain a select barrel 32. Barrel receptacle 38 may include any suitable barrel-retaining elements, such as threads sized and shaped to mate with threads of a barrel or, as can be appreciated by one skilled in the art, sized to be press-fit into the receiver and then held in place with a pin arrangement (not shown).

Follower rod cavity 40 is preferably sized and shaped to receive and retain a proximal end 48 of follower rod 26, providing a stationary fixture against which the follower rod is urged by biasing element 28. Cavity 40 is also preferably sized and shaped to allow a predetermined amount of pivoting action by proximal end 48 of follower rod 26 against a wall 50 of cavity 40 when operating rod 24 is urged rearwardly against the bias of biasing element 28 in the manner previously described.

In some embodiments of the present invention a follower rod pin 52 may be selectably coupled to receiver body 34. Follower rod pin 52 is shown only partially coupled to receiver body 34 in FIG. 6 in order to more clearly show cavity 40. In this embodiment proximal end 48 of follower rod 26 is coupled to follower rod pin 52 to provide a stationary fixture against which the follower rod is urged by biasing element 28. However, follower arm cavity 40 may alternatively be utilized for this purpose in the manner previous described, in the event that follower rod pin 52 is removed, damaged or lost without requiring disassembly of the rifle 10 to replace the follower arm pin.

Figure 6:
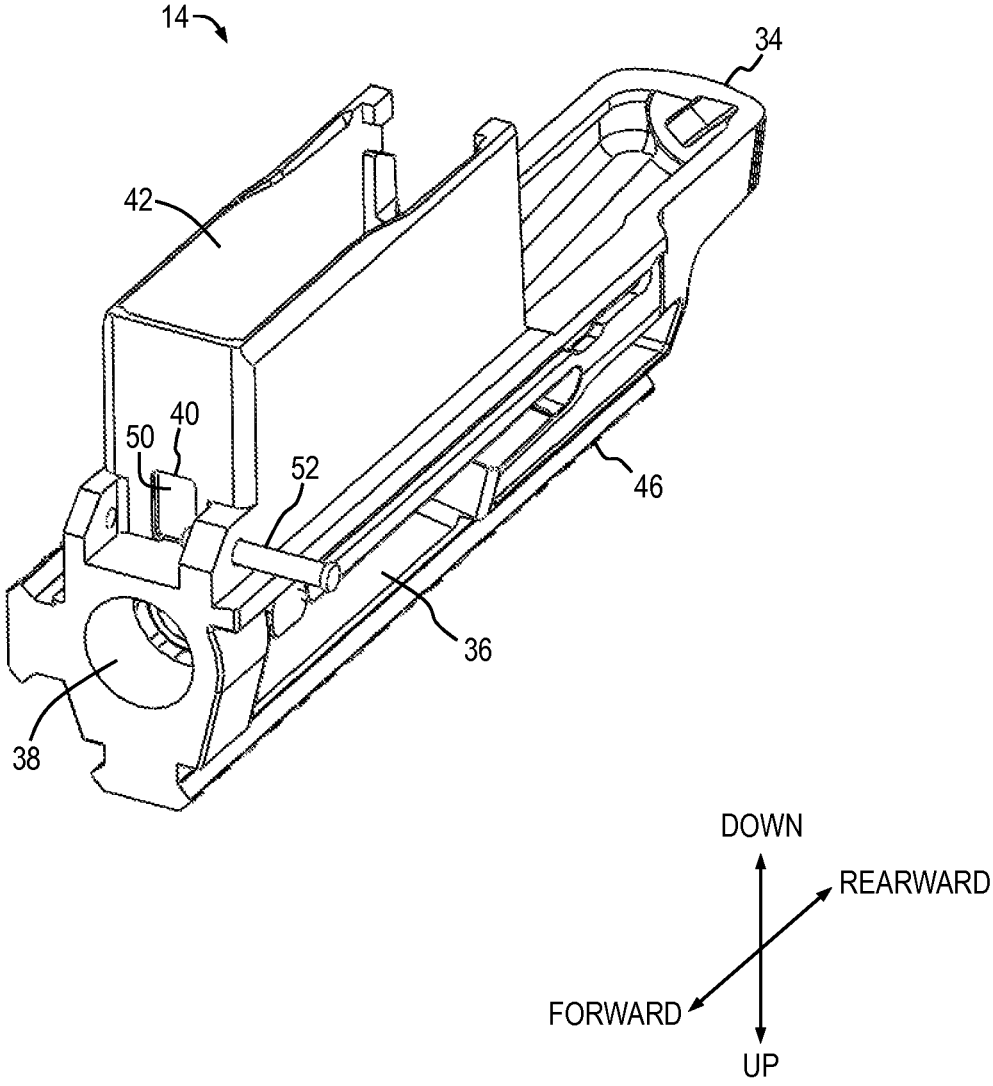
FIG. 6 is an inverted third perspective view of the receiver group of the rifle of FIG. 1.
Figure 7:
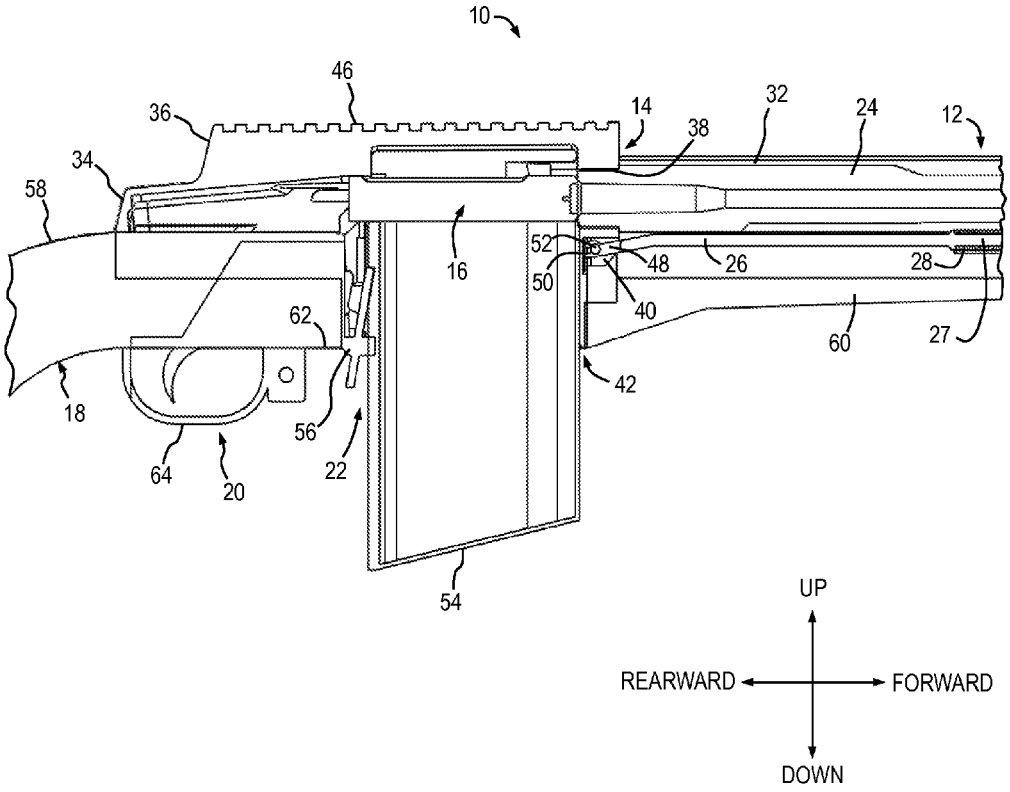
FIG. 7 is a partial cutaway view showing details of portions of the rifle of FIG. 1.
Figure 8:
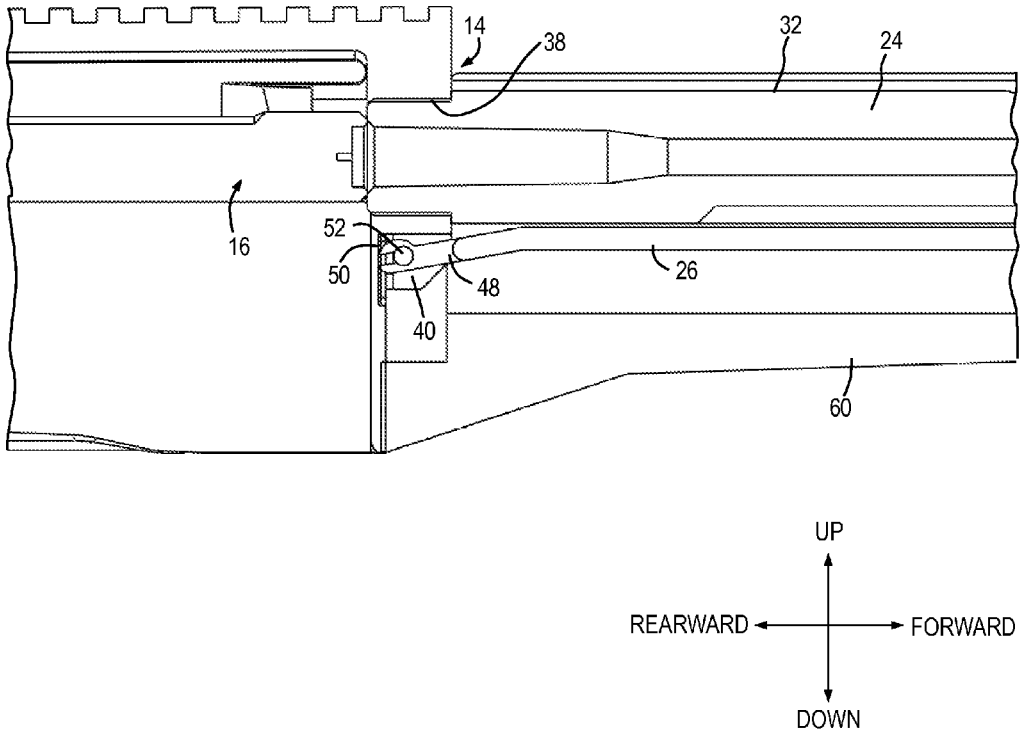
FIG. 8 is an enlarged partial cutaway view of FIG. 7 showing further details of the rifle of FIG. 1.

Magazine well 42 is a generally rectangularly-shaped opening extending into a lower portion of receiver body 34, as shown in FIG. 6. Magazine well 42 functions as a receptacle for a detachable magazine 54, the sidewalls of the magazine well providing support for the magazine. Magazine well 42 also serves as a recoil lug for the stock group 18. Magazine 54 is selectably coupled to receiver body by a latch 56 of trigger group 20, as shown in FIG. 7, which latch engages a corresponding recess in the surface of the magazine when fully inserted into the magazine well. Magazine 54 includes a spring loaded follower (not shown) configured for feeding rounds of ammunition to bolt group 16. Magazine 54 may be configured to hold 10, 20, 30 rounds or more, in contrast to the eight round limitation found in the M1 style rifle.

With reference again to FIG. 7, in one embodiment of the present invention bolt group 16 may be configured as a U.S. M1-type semi-automatic rifle. However, other sizes and configurations are within the scope of the present invention. Preferably the components of bolt group 16 are made from one or more of steel, titanium, aluminum and polymer materials and may be formed using any suitable processes including, without limitation, casting, machining and forging. Surfaces of the components of bolt group 16 may be prepared and treated with any of a nitride finish, a blued finish and a manganese phosphate finish, or may be left unfinished, in whole or in part. In addition, the components of bolt group 16 may be formed as an assembly of separate components, or may be made as a unitary piece. The components of bolt group 16 may be heat treated and/or shot peened as appropriate for the materials selected for the receiver body, such as with properties similar to 8620-type steel hardened to 55-59HRC to improve strength and durability.

Figure 3:
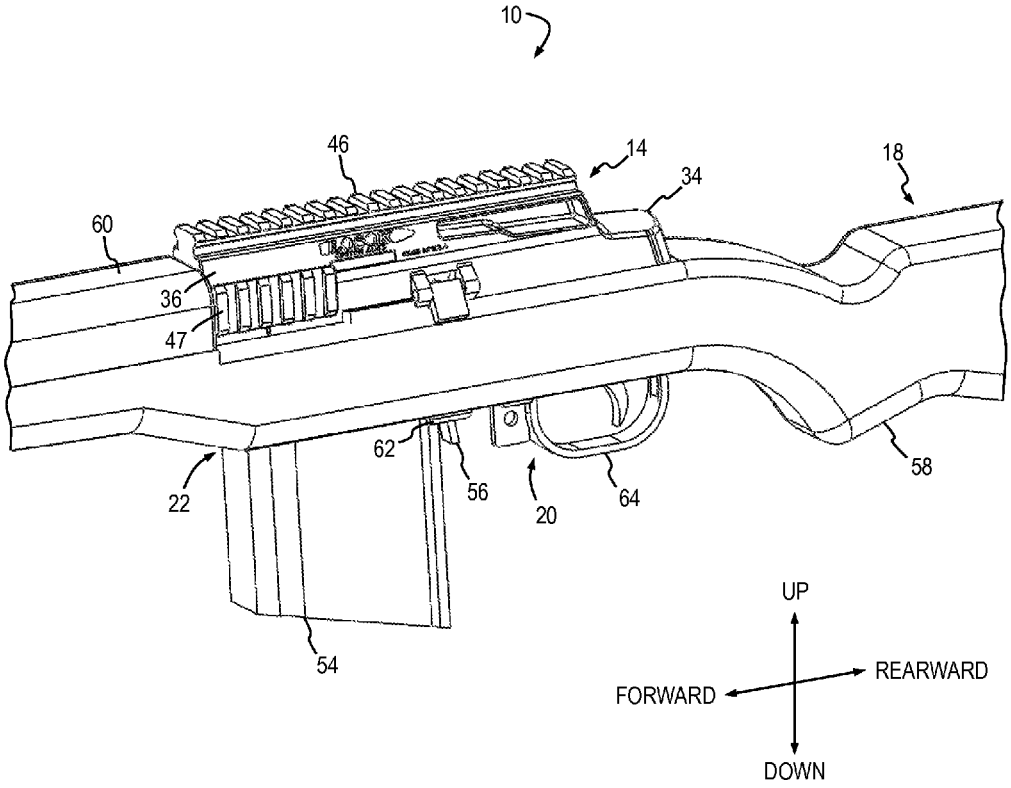
FIG. 3 is an enlarged partial view of the rifle of FIG. 1, showing details of the receiver group with a bolt stop release, a stock group, a trigger group and a magazine group.
Figure 4:
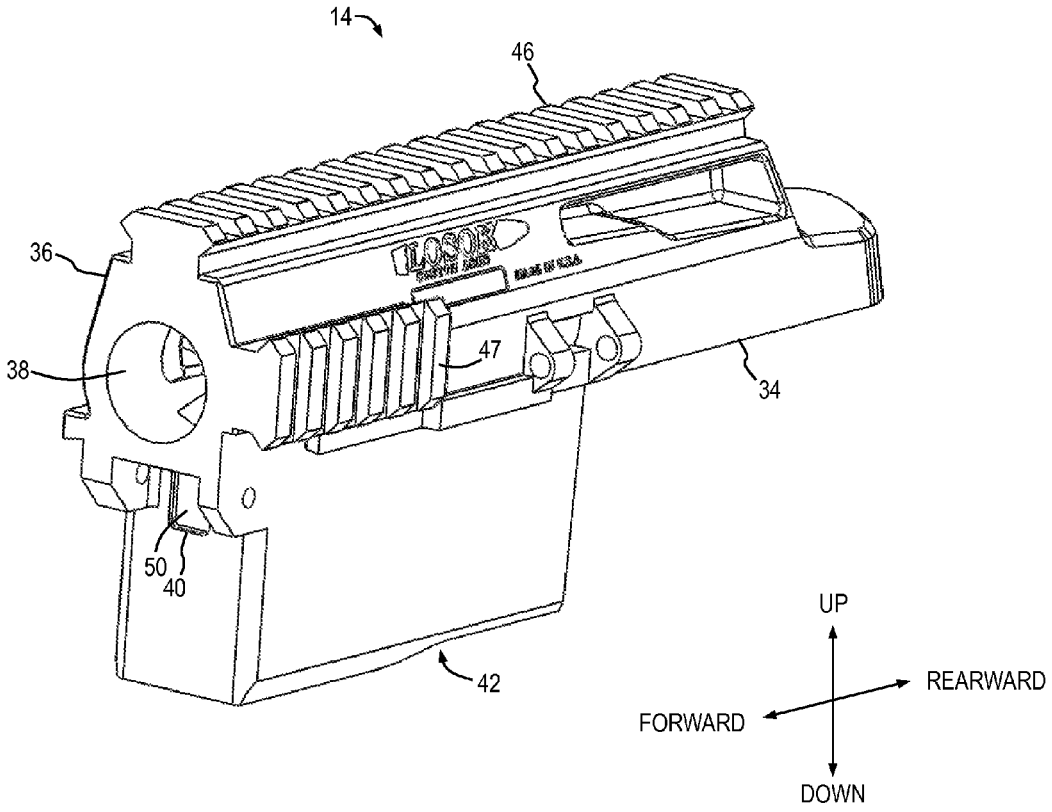
FIG. 4 is a first perspective view of the receiver group of the rifle of FIG. 1.
Figure 5:
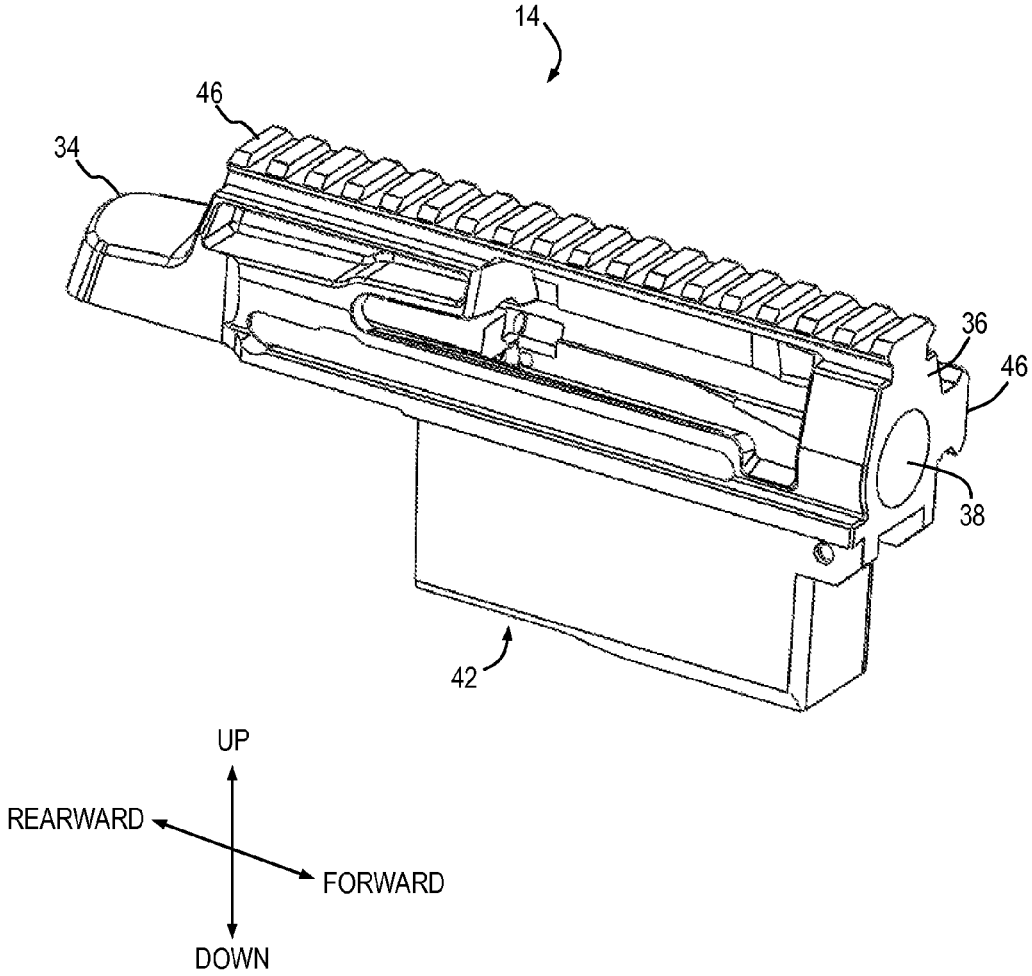
FIG. 5 is a second perspective view of the receiver group of the rifle of FIG. 1.

Stock group 18 is shown in FIGS. 1, 3 and 7. Preferably, stock group 18 is in a standard rifle configuration with a traditional stock 58, as well as a hand guard 60. The hand guard 60 is configured to mount to stock 58 without contacting or attaching to the barrel 32. The combined mounting of hand guard 60 independent of barrel 32 and stabilization of the hand guard during recoil against magazine well 42 provides a free floating barrel system that improves accuracy and reliability. Preferably, the components of stock group 18 are made from one or more of wood, polymer materials, composites and metals and may be formed using any suitable processes including, without limitation, casting, machining and carving. Surfaces of the components of stock group 18 may be prepared and treated with any of a stain, paint, metalized spray coating, anodizing, or may be left unfinished, in whole or part. In addition, at least some of the various components of stock group 18 may be formed as an assembly of separate components, or may be made as a unitary piece.

Trigger group 20 is shown in FIGS. 1, 3 and 7. In one embodiment trigger group 20 is configured similar to that of a U.S. M14-type rifle herein, although other configurations are envisioned within the scope of the invention. Trigger group 20 includes magazine release latch 56, as well as a set of guide arms 62 to ease entry of magazine 54 into magazine well 42. Guide arms 62 also serve to help secure the rifle to stock 58, and locate the position of receiver group 14 by aligning the receiver group with the magazine well 54 of the receiver body 34. A trigger guard 64 is used to detachably secure trigger group 20 to receiver group 14 proximate magazine well 42, thereby selectably coupling stock 58 to the rifle 10.

Preferably, the components of trigger group 20 are made from one or more of steel, titanium, aluminum and polymer materials and may be formed using any suitable processes including, without limitation, casting, machining and forging. Surfaces of the components of trigger group 20 may be prepared and treated with any of a nitride finish, a blued finish and a manganese phosphate finish, or may be left unfinished, in whole or part. In addition, at least some of the various components of trigger group 20 may be formed as an assembly of separate components, or may be made as a unitary piece. The components of trigger group 20 may be heat treated and/or shot peened as appropriate for the materials selected for the components of the trigger group.

Magazine group 22 is shown in FIGS. 1, 3 and 7. Magazine group 22 is configured similar to that of an M14-type rifle herein, although other configurations and cartridge capacities are envisioned within the scope of the invention. Preferably, the components of magazine group 22 are made from one or more of steel, titanium, aluminum and polymer materials and may be formed using any suitable processes including, without limitation, casting, machining and forging. Surfaces of the components of magazine group 22 may be prepared and treated with any of a nitride finish, a blued finish and a manganese phosphate finish, or may be left unfinished, in whole or part. In addition, at least some of the various components of magazine group 22 may be formed as an assembly of components, or may be made as a unitary piece. The components of magazine group 22 may be heat treated and/or shot peened as appropriate for the materials selected for the components of the magazine group.

While this invention has been shown and described with respect to a detailed embodiment thereof, it will be understood by those skilled in the art that changes in form and detail thereof may be made without departing from the scope of the claims of the invention.

What is claimed is:

1. A semi-automatic rifle, comprising:

a receiver group having a receiver body, the receiver body further including a rectangular-shaped magazine well formed in a lower portion of the receiver body;

a barrel group having a gas-operated operating rod, the operating rod further coupled to and guided by a follower rod, the operating rod being biased away from the follower rod; and a cavity formed in a forward portion of the receiver body, the cavity being sized and shaped to receive and movably retain a proximal end of the follower rod; wherein the follower rod is configured to pivot about an axis perpendicular to the follower rod and against a forward facing wall of the cavity during operation of the semi-automatic rifle.

2. The rifle of claim 1, further including a follower arm rod selectably coupled to the receiver body, the proximal end of the follower rod being one of movably coupled to the pin and movably retained by the cavity.

3. The rifle of claim 1, further comprising a receiver cover, the receiver cover closing off an upper portion of the receiver body.

4. The cover of claim 3, wherein the receiver cover is a separate piece, the receiver cover being joined to the receiver body.

5. The receiver cover of claim 3 wherein the receiver cover is integral to the receiver body.

6. The receiver cover of claim 3 wherein the receiver cover further includes an accessory mounting portion.

7. The rifle of claim 1 wherein the receiver body further includes an accessory mounting portion.

8. The rifle of claim 1 wherein the magazine well is an opening configured for selectable reception of a detachable magazine and extending up through the lower portion of the receiver body.

9. The rifle of claim 1 wherein the receiver body is a unitary piece.

10. The rifle of claim 1 wherein the receiver body is made from one or more of steel, titanium, aluminum and polymer materials.

11. The rifle of claim 1 wherein the receiver body further includes at least one of a nitride finish, a blued finish and a manganese phosphate finish.

12. The rifle of claim 1 wherein the receiver body is formed by one or more of casting, machining and forging.

13. The rifle of claim 1 wherein the receiver body is at least one of heat treated and shot peened.

14. A semi-automatic rifle, comprising:

a receiver group having a receiver body;

a receiver cover, the receiver cover closing off an upper portion of the receiver body;

a magazine well formed in a lower portion of the receiver body, the magazine well configured to receive rounds of ammunition from a spring fed magazine;

a bolt group configured to expel a spent shell casing from an expended round and to feed a new round;

a barrel group having a gas-operated operating rod coupled to the bolt group, the operating rod further coupled to and guided by a follower rod, the operating rod being biased away from the follower rod;

a cavity formed in a forward portion of the receiver body, the cavity being sized and shaped to receive and movably retain a proximal end of the follower rod; and a follower rod pin removably fixed to the receiver body and configure to pivotably retain the follower rod, wherein during operation of the semi-automatic rifle the movement of the follower rod is limited by at least one of the follower rod pin and a forward facing wall of the cavity.

15. The rifle of claim 14 wherein the receiver body is a unitary piece.

16. The rifle of claim 14 wherein the receiver body further includes an accessory mounting portion.

17. The cover of claim 14 wherein the receiver cover is integral to the receiver body.

18. The cover of claim 14 wherein the receiver cover is a separate piece, the receiver cover being joined to the receiver body.

19. The receiver cover of claim 14 wherein the receiver cover further includes an accessory mounting portion.

20. A method for constructing a semi-automatic rifle, comprising the steps of:

providing a receiver group having a receiver body, the receiver body further including a rectangular-shaped magazine well formed in a lower portion of the receiver body;

providing a barrel group having a gas-operated operating rod, the operating rod further coupled to and guided by a follower rod, the operating rod being biased away from the follower rod; and forming a cavity in a forward portion of the receiver body, the cavity being sized and shaped to receive and movably retain a proximal end of the follower rod; wherein the follower rod is configured to pivot about an axis perpendicular to the follower rod and against a forward facing wall of the cavity during operation of the semi-automatic rifle.

* * * * *